US009412535B2

(12) United States Patent
Hsu

(10) Patent No.: US 9,412,535 B2
(45) Date of Patent: Aug. 9, 2016

(54) KEYSWITCH STRUCTURE

(71) Applicant: DARFON ELECTRONICS CORP., Taoyuan (TW)

(72) Inventor: Chien-Shih Hsu, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 14/819,404

(22) Filed: Aug. 5, 2015

(65) Prior Publication Data

US 2016/0055989 A1 Feb. 25, 2016

(30) Foreign Application Priority Data

Aug. 21, 2014 (TW) ..... 103128867 A

(51) Int. Cl.
*H01H 13/14* (2006.01)

(52) U.S. Cl.
CPC ..... *H01H 13/14* (2013.01); *H01H 2215/00* (2013.01); *H01H 2221/058* (2013.01); *H01H 2227/032* (2013.01)

(58) Field of Classification Search
CPC ..... H01H 13/14; H01H 2221/058; H01H 2215/00; H01H 2227/032; H01H 2231/002; H01H 13/7065; H01H 3/125; H01H 2221/04; H01H 3/122; H01H 3/503; H01H 3/506; H01H 13/00; H01H 13/02; H01H 13/20; H01H 13/52; H01H 9/00
USPC ..... 200/344, 341, 404; 400/495
See application file for complete search history.

(56) References Cited

U.S. PATENT DOCUMENTS

| | | | | |
|---|---|---|---|---|
| 6,677,843 | B1 * | 1/2004 | Monroe | H01H 13/705 200/512 |
| 8,970,331 | B2 * | 3/2015 | Chang | H01H 13/702 200/341 |
| 9,064,651 | B2 * | 6/2015 | Hsu | H01H 13/7065 |

FOREIGN PATENT DOCUMENTS

| | | |
|---|---|---|
| CN | 103165326 A | 6/2013 |
| CN | 203312112 U | 11/2013 |
| JP | 2002149336 | 5/2002 |
| JP | 2012173881 | 9/2012 |
| TW | 201042688 | 12/2010 |
| TW | 201423811 | 6/2014 |
| TW | M482153 | 7/2014 |

* cited by examiner

*Primary Examiner* — Edwin A. Leon
(74) *Attorney, Agent, or Firm* — Winston Hsu; Scott Margo

(57) ABSTRACT

A keyswitch structure includes a base, a keycap, a lift mechanism, and a magnetic member. The keycap is capable of moving up and down relative to the base through the lift mechanism. The lift mechanism includes a support that has a side edge portion, abutting against the base through a sharp edge, and a magnetic portion at the side edge portion. The magnetic portion extends outward from the side edge portion. The support is movably connected to the keycap through another side edge portion of the support. The magnetic member is disposed on the base corresponding to the magnetic portion. The magnetic portion and the magnetic member produce a magnetic attraction force therebetween. When an external force applied to the keycap is eliminated, the magnetic attraction force drives the support to rotate about the sharp edge relative to the base, so that the keycap moves away from the base.

30 Claims, 11 Drawing Sheets

KEYSWITCH STRUCTURE

BACKGROUND OF THE INVENTION

1. Field of the Invention

The invention relates to a keyswitch structure, and especially relates to a mechanical keyswitch structure.

2. Description of the Prior Art

A stroke of a keycap of conventional keyswitches is relatively long, so it is easy to dispose a rubber dome under the keycap so that when the keycap is pressed to move downward, the rubber dome is also deformed and produces resilient force, and when the keycap is released, the resilient force drives the keycap to move upward to its original position. However, with a tendency toward keyboard miniaturization, the stroke of the keycap is required to decrease, so the height of the rubber dome is also required to lower. The service life and the character of resilient force will decay with a height of the rubber dome decreasing. Furthermore, for a keyswitch with a longer length (or called a multiple-width keyswitch), a plurality of links are disposed under the keycap so that the keycap can keep being horizontally moved up and down when a user presses any portion of the keycap, and the user can feel a distinct force feedback (or tactile feedback). However, if the height of the keycap is required to decrease more, the above design may not be accomplished easily due to space constraint.

SUMMARY OF THE INVENTION

An objective of the invention is to provide a keyswitch structure that uses a magnetic attraction force in cooperation with supports with lever structure to produce stable movement of the keycap and further distinct and stable tactile feedback when pressing the keycap.

In an embodiment, a keyswitch structure according to the invention includes a base, a keycap, a lift mechanism, and a first magnetic member. The lift mechanism is disposed between the base and the keycap. The keycap is capable of moving up and down in a vertical direction relative to the base through the lift mechanism. The lift mechanism includes a first support. The first support has a first side edge portion, a second side edge portion, and a first magnetic portion. The first side edge portion keeps abutting against the base through a sharp edge. The second side edge portion is opposite to the first side edge portion and movably connected with the keycap. The first magnetic portion extends outward from the first side edge portion. The first magnetic member is disposed on the base corresponding to the first magnetic portion. The first magnetic member and the first magnetic portion produce a magnetic attraction force therebetween. Thereby, when the keycap is pressed by an external force, the first support rotates about the sharp edge relative to the base, so that the first magnetic portion moves away from the first magnetic member and the keycap approaches the base. Therein, the magnetic attraction force decreases as the first magnetic portion moves away from the first magnetic member, which facilitates the keycap approaching the base. When the external force is eliminated, the magnetic attraction force drives the first support to rotate (i.e. reversely rotate) about the sharp edge relative to the base so that the second side edge portion of the first support makes the keycap move away from the base.

In another embodiment, a keyswitch structure according to the invention includes a base, a keycap, a lift mechanism, and a first magnetic member. The lift mechanism is disposed between the base and the keycap. The keycap is capable of moving up and down in a vertical direction relative to the base through the lift mechanism. The lift mechanism includes a first support and a second support. The first support has a first side edge portion, a second side edge portion, and a first magnetic portion. The first side edge portion keeps abutting against the base. The second side edge portion is opposite to the first side edge portion and movably connected to the keycap. The first magnetic portion extends outward from the first side edge portion. The second support is disposed opposite to the first support. The second support has a third side edge portion and a fourth side edge portion. The third side edge portion keeps abutting against the base. The fourth side edge portion is opposite to the third side edge portion and movably connected to the keycap. The first magnetic member is disposed on the base corresponding to the first magnetic portion. The first magnetic member and the first magnetic portion produce a magnetic attraction force therebetween. Thereby, when the keycap is pressed by an external force, the first support rotates about the first side edge portion relative to the base, so that the first magnetic portion moves away from the first magnetic member and the keycap approaches the base. Therein, the magnetic attraction force decreases as the first magnetic portion moves away from the first magnetic member, which facilitates the keycap approaching the base. When the external force is eliminated, the magnetic attraction force drives the first support to rotate (i.e. reversely rotate) about the first side edge portion relative to the base so that the second side edge portion of the first support makes the keycap move away from the base.

In another embodiment, a keyswitch structure according to the invention includes a base, a keycap, a lift mechanism, and a second magnetic member. The lift mechanism is disposed between the base and the keycap. The keycap is capable of moving up and down in a vertical direction relative to the base through the lift mechanism. The lift mechanism includes a first support. The first support has a first side edge portion, a second side edge portion, and a second magnetic portion. The first side edge portion keeps abutting against the base. The second side edge portion is opposite to the first side edge portion and movably connected to the keycap. The second magnetic member is disposed corresponding to the second magnetic portion on the base under the first side edge portion. Therein, the second magnetic portion and the second magnetic member produce a magnetic attraction force therebetween for driving the first side edge portion to abut against the base so that the first support can rotate relative to the base through the first side edge portion stably.

Compared with the prior art, the keyswitch structure according to the invention uses the magnetic attraction force as a driving force for returning the keycap to its original position without a rubber dome and a link bar, so a disposition space for the keyswitch structure can be reduced and the keyswitch structure can be compact, which is conducive to a reduction of the height of the keyswitch structure. Furthermore, in the keyswitch structure according to the invention, the support uses its sharp edge to abut against the base and rotates about the sharp edge, so the support can stably and precisely rotate relative to the base and a rotation friction is reduced, which provides a user distinct and stable tactile feedback when pressing the keycap. In addition, when the keyswitch structure according to the invention is applied to a keyswitch with a longer length (or called a multiple-width keyswitch), the keycap of keyswitch structure has a longer length, and the first side edge portion and the second side edge portion of the first support are also longer. In principle, the constraint effect by the magnetic attraction force between the first magnetic member and the first magnetic portion on the first side edge portion (i.e. driving the first side edge portion to keep abutting against the base) weakens with a distance to the first magnetic member (or the first magnetic portion) increasing, but the whole first side edge portion still can keep abutting against the base by the magnetic attraction force between the second magnetic member and the second magnetic portion, so that the first support (especially the two end portions) will not be deformed or bent. Thereby, no matter which portion of the keycap an external force is applied to, the keycap makes the first support rotate about the first side edge portion relative to the base through the second side edge portion, so that the magnetic portion moves away from the magnetic member and the keycap approaches the base steadily.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
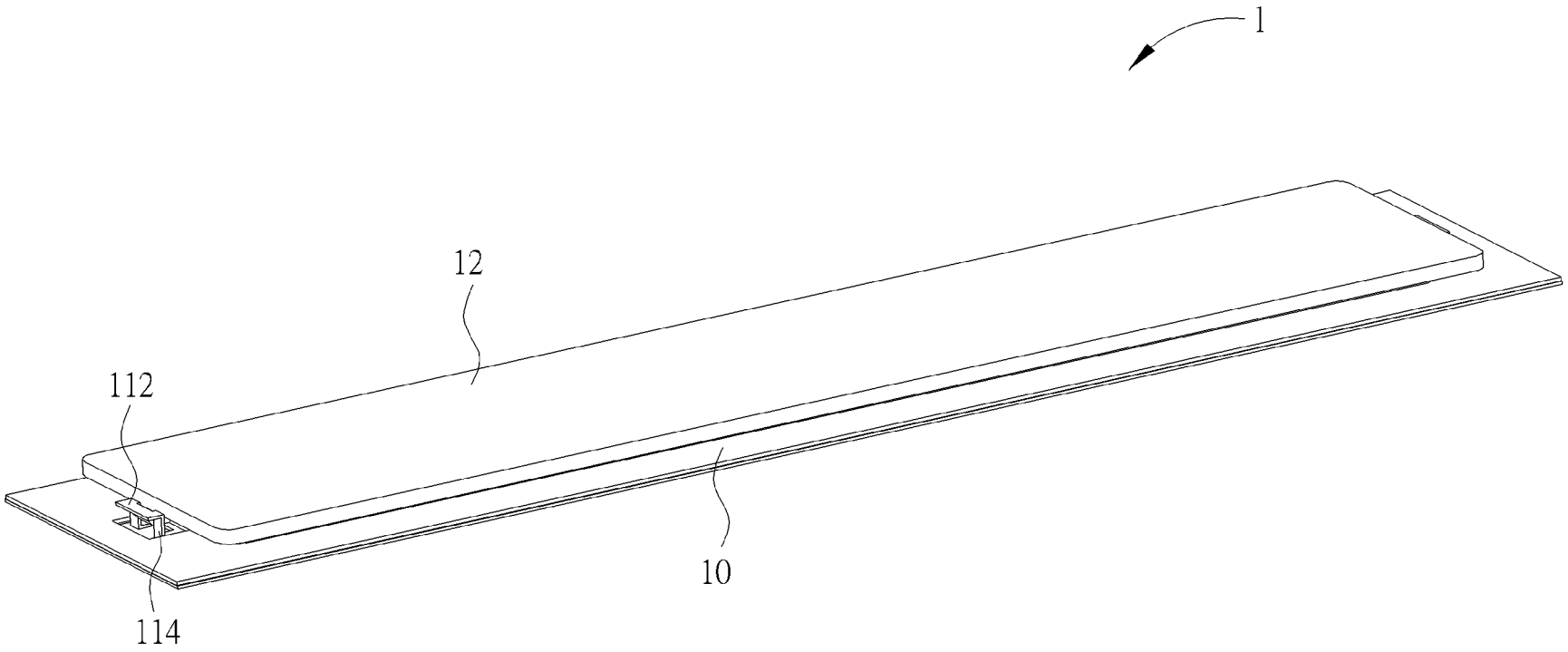
FIG. 1 is a schematic diagram illustrating a keyswitch structure of an embodiment according to the invention.
Figure 2:
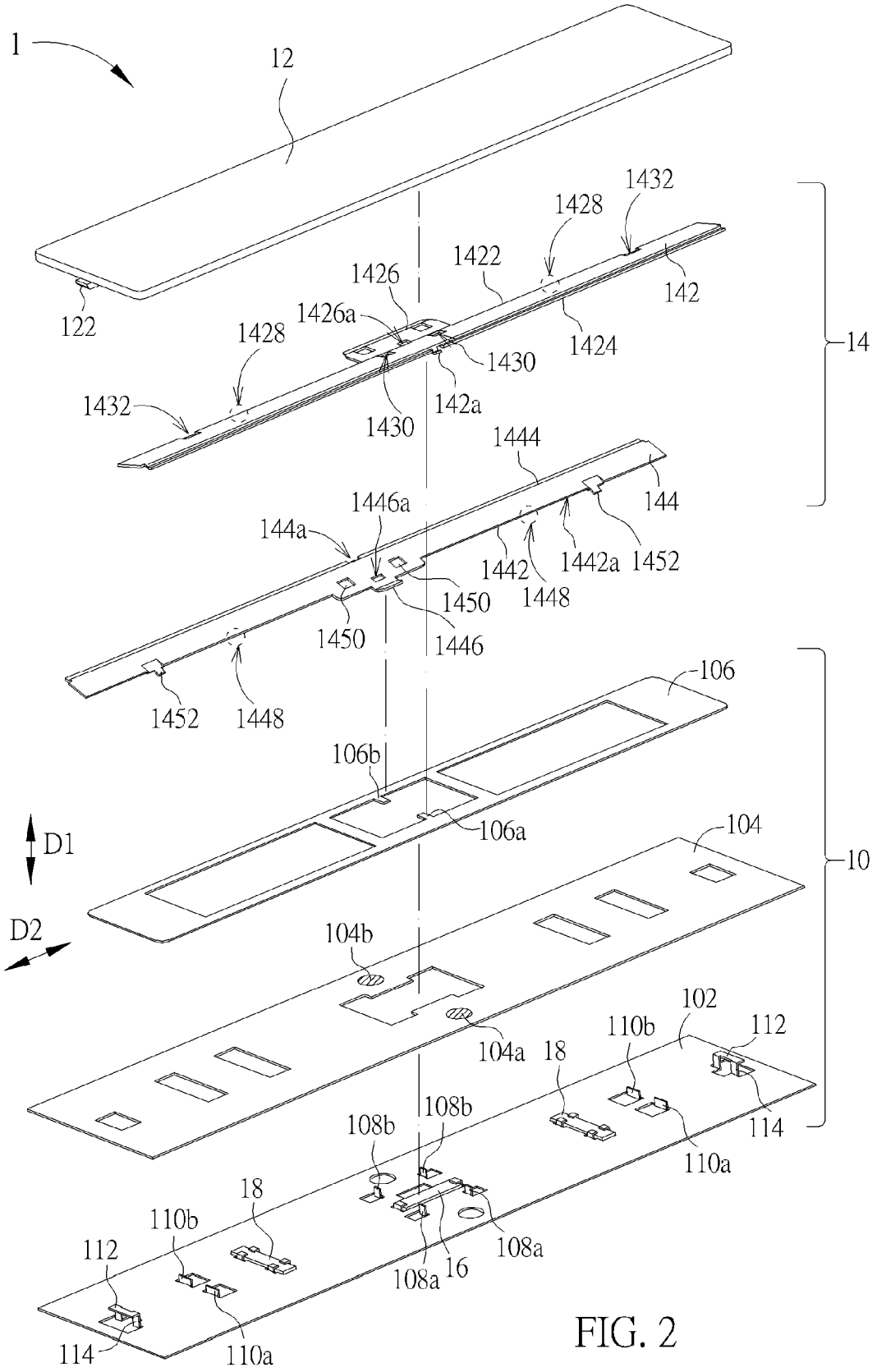
FIG. 2 is an exploded view of the keyswitch structure in FIG. 1.
Figure 3:
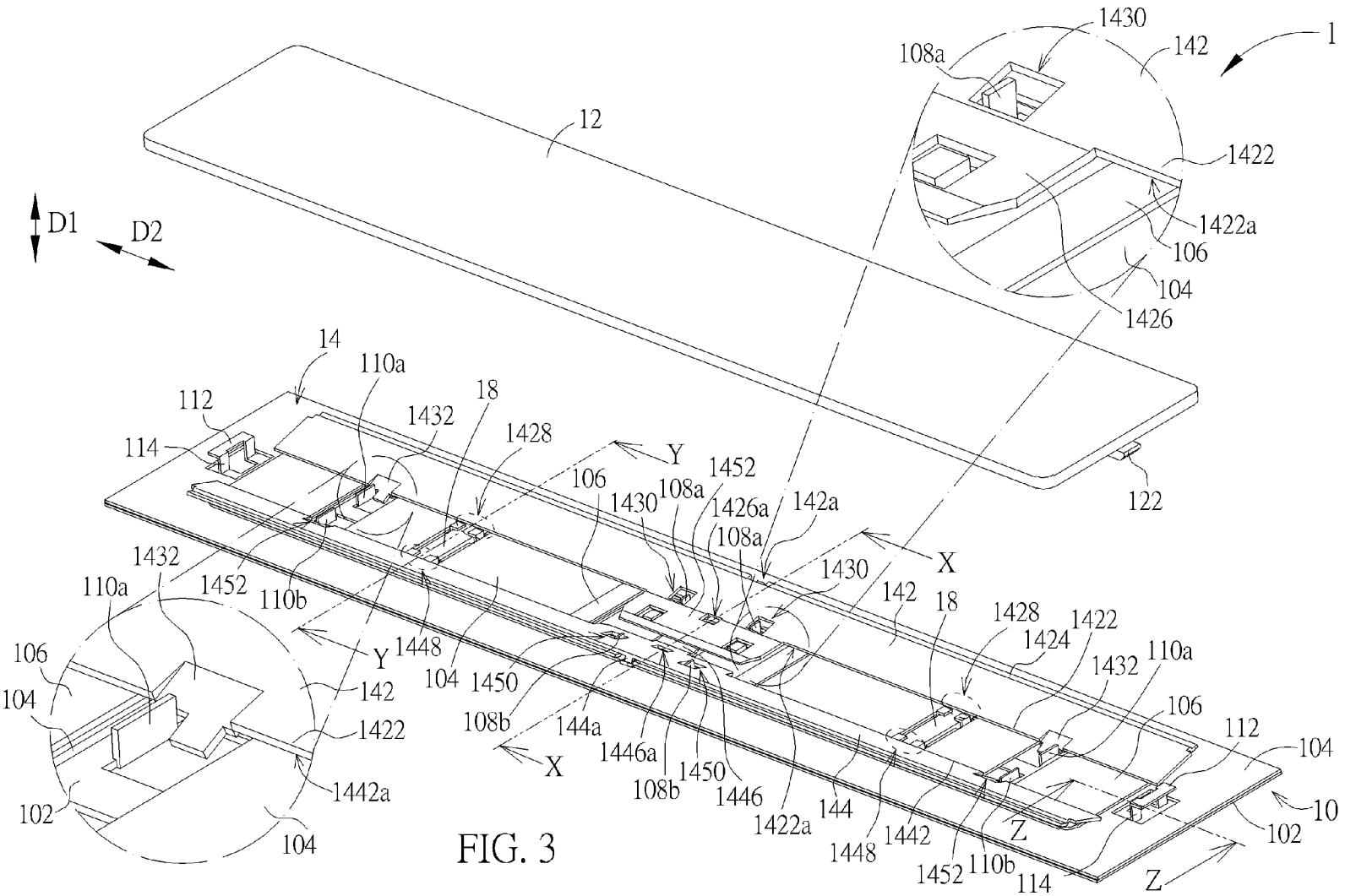
FIG. 3 is a partially-exploded view of the keyswitch structure in FIG. 1.
Figure 4:
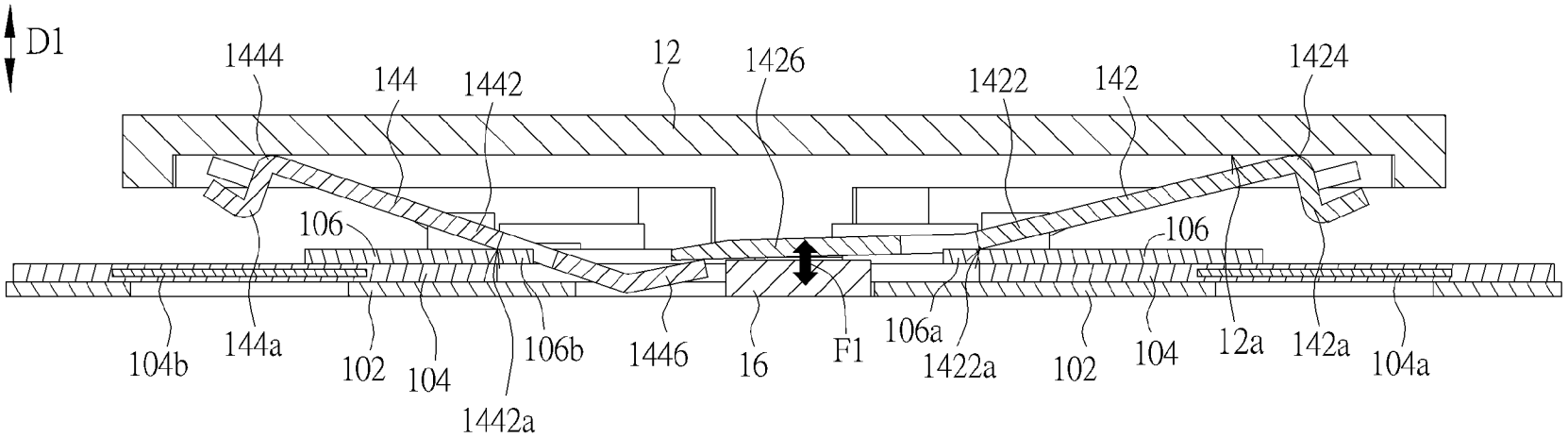
FIG. 4 is a sectional view of the keyswitch structure along the line X-X in FIG. 3.
Figure 5:
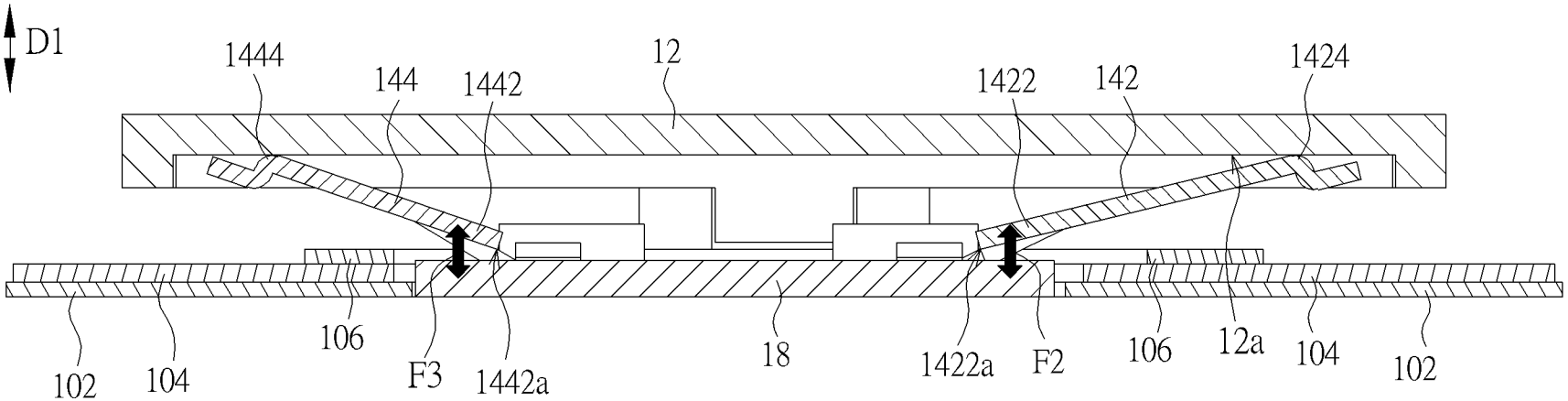
FIG. 5 is another sectional view of the keyswitch structure along the line Y-Y in FIG. 3.

Please refer to FIGS. 1-5. FIG. 1 is a schematic diagram illustrating a keyswitch structure 1 of an embodiment according to the invention. FIG. 2 is an exploded view of the keyswitch structure 1. FIG. 3 is a partially-exploded view of the keyswitch structure 1. FIG. 4 is a sectional view of the keyswitch structure 1 along the line X-X in FIG. 3. FIG. 5 is another sectional view of the keyswitch structure 1 along the line Y-Y in FIG. 3. The keyswitch structure 1 includes abase 10, a keycap 12, a lift mechanism 14, a first magnetic member 16, and two second magnetic members 18. The keycap 12 is disposed above the base 10. The lift mechanism 14 is disposed between the base 10 and the keycap 12, so that the keycap 12 is capable of moving up and down in a vertical direction D1 relative to the base 10 through the lift mechanism 14. The first magnetic member 16 and the second magnetic members 18 are disposed on the base 10. The first magnetic member 16 and the second magnetic members 18 respectively can produce a magnetic attraction force F1 (indicated by a solid line segment with an arrow in FIG. 4) to the lift mechanism 14 for stabilizing the movement of the lift mechanism 14 so that the keycap 12 can steadily move up and down relative to the base 10.

Further, in the embodiment, the base 10 includes a bottom plate 102, a membrane circuit board 104, and an abutting plate 106. The first magnetic member 16 and the second magnetic members 18 are disposed on the bottom plate 102. The membrane circuit board 104 is disposed on the bottom plate 102 and has two switches 104*a* and 104*b* (represented by hatched circles). The abutting plate 106 is stacked on the membrane circuit board 104 for the lift mechanism 14 to abut against. The abutting plate 106 also increases the abutting area of the lift mechanism 14 and the base 10, which is conducive to avoidance of the lift mechanism 14 structurally interfering with the first magnetic member 16 and the second magnetic members 18 when in operation.

The lift mechanism 14 includes a first support 142 and a second support 144. The first support 142 and the second support 144 are oppositely disposed on the base 10. The first support 142 has a first side edge portion 1422, a second side edge portion 1424, and a first magnetic portion 1426. The first side edge portion 1422 has a sharp edge 1422*a* and keeps abutting against the abutting plate 106 of the base 10 through the sharp edge 1422*a*. The second side edge portion 1424 is opposite to the first side edge portion 1422 and movably connected to a bottom surface 12*a* of the keycap 12. The first magnetic portion 1426 extends outward from the first side edge portion 1422, i.e. extending in a direction opposite to the second side edge portion 1424. The second support 144 has a third side edge portion 1442, a fourth side edge portion 1444, and an abutting portion 1446. The third side edge portion 1442 keeps abutting against the abutting plate 106 of the base 10. The fourth side edge portion 1444 is opposite to the third side edge portion 1442 and movably connected to the bottom surface 12*a* of the keycap 12. The abutting portion 1446 extends outward from the third side edge portion 1442, i.e. extending in a direction opposite to the fourth side edge portion 1444. The abutting portion 1446 is located between the first magnetic portion 1426 and the base 10 and used for abutting against the first support 142. Furthermore, it is added that the movable connections of the keycap 12 with the second side edge portion 1424 and the fourth side edge portion 1444 are not limited to a case that the second side edge portion 1424 and the fourth side edge portion 1444 are structurally engaged with the keycap 12. In practice, any connection that makes the keycap 12 move up and down as the lift mechanism 14 moves when the keyswitch structure 1 acts (e.g. a user presses the keycap 12) is practicable. In the embodiment, the keycap 12 is not provided with any specific structure for engaging with the lift mechanism 14, but directly placed on the lift mechanism 14. The second side edge portion 1424 and the fourth side edge portion 1444 individual contact the bottom surface 12*a* of the keycap 12. When the keycap 12 moves up and down relative to the base 10 through the lift mechanism 14, the second side edge portion 1424 and the fourth side edge portion 1444 slide on the bottom surface 12*a*.

The first magnetic member 16 is disposed on the bottom plate 102 of the base 10 corresponding to the first magnetic portion 1426, i.e. between the first support 142 and the second support 144. The first magnetic member 16 and the first magnetic portion 1426 produce the magnetic attraction force F1 therebetween (indicated by a solid line segment with an arrow in FIG. 4). In practice, the first magnetic member 16 can be a magnet while the first magnetic portion 1426 can be provided with a portion of magnet or be made of paramagnetic material or other material capable of producing an induced magnetic field. In the embodiment, the whole first support 142 is a stamping part of paramagnetic ferro-material, so the first magnetic portion 1426 can be attracted directly by the first magnetic member 16, which implements the above magnetic attraction force F1. Under the effect of the magnetic attraction force F1, the first magnetic portion 1426 has a tendency to move downward, so that the first magnetic portion 1426 can keep abutting against the abutting portion 1446. Therefore, when the magnetic attraction force F1 drives the first magnetic portion 1426 to approach the first magnetic member 16, the abutting portion 1446 located between the first magnetic portion 1426 and the base 10 sustains a pressing by the first magnetic portion 1426 to move toward the base 10, so that the first support 142 rotates about the sharp edge 1422*a* relative to the abutting plate 106 of the base 10 and the second support 144 rotates about the third side edge portion 1442 relative to the abutting plate 106 of the base 10, so that the keycap 12 moves away from the base 10. It is added that in the embodiment, the abutting portion 1446 abuts against the first magnetic portion 1426, but the invention is not limited thereto. In other words, that the abutting portion 1446 abuts against the first support 142 shows a structural contact relation, so it is unnecessary for the portions by which the first support 142 and the abutting portion 1446 abut against each other to be magnetic. For example, the abutting portion 1446 is modified to abut against another portion of the first support 142 (e.g. a structure protruding from the first side edge portion 1422 in a direction opposite to the second side edge portion 1424 for the abutting portion 1446 to abut against).

In addition, based on FIG. 4, when a user presses the keycap 12, the first magnetic portion 1426 of the first support 142 sustains the magnetic attraction force F1, the second side edge portion 1424 sustains the pressing force by the user through the keycap 12, and the first side edge portion 1422 of the first support 142 sustains a fulcrum supporting force by the abutting plate 106, so that the first support 142 functions as a lever and provides supporting. When the user presses the keycap 12, a resilient force received by the user depends on the magnetic attraction force F1 and distances to the fulcrum of the lever. In the embodiment, the first support 142 takes the sharp edge 1422*a* as the fulcrum for rotation and further for avoidance of rotational friction force, so that the first support 142 provides the keycap 12 relatively fixed distances to the fulcrum, which facilitates the design of the resilient force (i.e. the tactile feedback received by the user). Similarly, in the embodiment, the second support 144 is provided in the same design. The second support 144 keeps abutting against the abutting plate 106 of the base 10 through a sharp edge 1442*a* of the third side edge portion 1442, but the invention is not limited thereto. It is added that in the embodiment, the first support 142 and the second support 144 extend in a horizontal direction D2 (perpendicular to the vertical direction D1). The sharp edges 1422*a* and 1442*a* are structural edges of the first support 142 and the second support 144 extending in the horizontal direction D2 respectively. Although the first support 142 and the second support 144 form other structures (e.g. the first magnetic portion 1426 and the abutting portion 1446) with breaking the edges into a plurality of edge segments, the edge segments all can be regarded as the sharp edges 1422*a* and 1442*a* and in logic the two sets of the plurality of edge segments can be regarded as the sharp edges 1422*a* and 1442*a* according to the invention. For example, an incomplete hole 1426*a* of the first magnetic portion 1426 and an incomplete hole 1446*a* of the abutting portion 1446 still remain a structural edge as a portion of the sharp edges 1422*a* and 1442*a* respectively; the abutting plate 106 has protrusions 106*a* and 106*b* for the structural edges to abut against.

The second magnetic members 18 are oppositely disposed on the bottom plate 102 of the base 10 relative to the first magnetic member 16. The second magnetic members 18 are located between the first support 142 and the second support 144 under the first side edge portion 1422 and the third side edge portion 1442; that is, projections of the second magnetic members 18 in the vertical direction D1 overlap projections of the first support 142 and the second support 144 in the vertical direction D1. The first support 142 has two second magnetic portions 1428 (of which the positions are indicated by dashed circles in FIG. 2) facing the second magnetic members 18. Each pair of one second magnetic portion 1428 and one second magnetic member 18 produce a magnetic attraction force F2 (indicated by a solid line segment with an arrow in FIG. 5) therebetween. Similarly, the second support 144 has two magnetic portions 1448 (of which the positions are indicated by dashed circles in FIG. 2) facing the second magnetic members 18. Each pair of one magnetic portion 1448 and one second magnetic member 18 produce a magnetic attraction force F3 (indicated by a solid line segment with an arrow in FIG. 5) therebetween. In the embodiment, each of the first support 142 and the second support 144 is a stamping part of paramagnetic ferro-material, so the magnetic portions 1428 and 1448 are the portions of the first support 142 and the second support 144 facing to the second magnetic members 18. The magnetic attraction force F2 can drive the first support 142 to abut against the base 10 through the sharp edge 1422*a*. Similarly, the magnetic attraction force F3 can drive the second support 144 to abut against the base 10 through the sharp edge 1442*a*.

It is added that the first magnetic member 16 and the second magnetic members 18 are arranged in the horizontal direction D2. The first magnetic member 16 is located substantially at the middle of the two second magnetic members 18. The first magnetic portion 1426 is located at a middle portion of the first side edge portion 1422. The abutting portion 1446 is located at a middle portion of the third side edge portion 1442. The symmetric disposition is conducive to the balance of the first support 142 and the second support 144 when sustaining force, and to the movement stability of the lift mechanism 14. Furthermore, the second magnetic members 18 are also conducive to the sharp edges 1422*a* and 1442*a* abutting against the abutting plate 106. The second magnetic members 18 are also located between the first support 142 and the second support 144, which is conducive to the first support 142 and the second support 144 approaching each other. Therefore, as a whole, the lift mechanism 14 is structurally stable in the keyswitch structure 1. Therein, the first support 142 and the second support 144 can stably and reliably rotate about the sharp edges 1422*a* and 1442*a* respectively relative to the base 10 (or the abutting plate 106), so that the keyswitch structure 1 provides the user stable and reliable tactile feedback.

Figure 6:
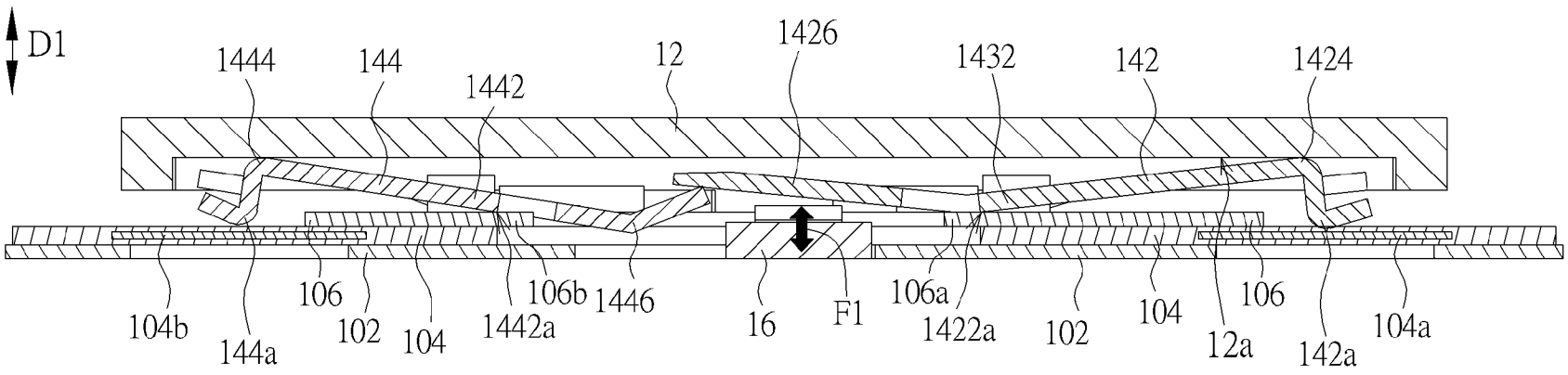
FIG. 6 is a sectional view of the keyswitch structure in FIG. 4 with the keycap having been pressed.
Figure 7:
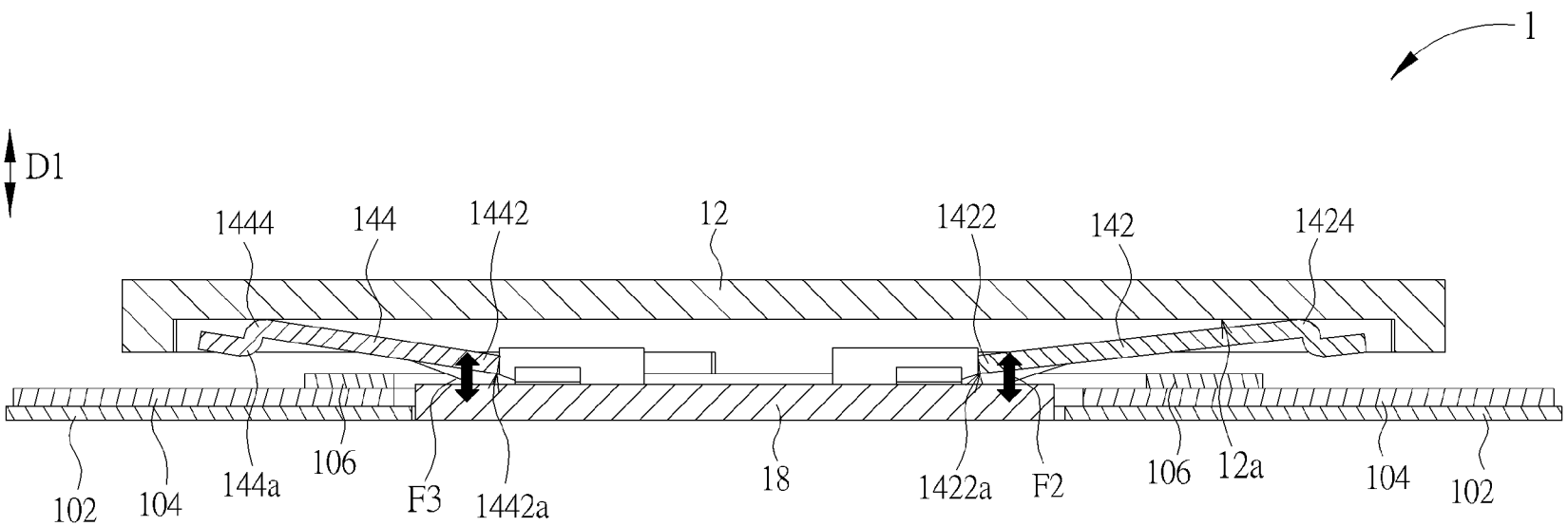
FIG. 7 is a sectional view of the keyswitch structure in FIG. 5 with the keycap having been pressed.

Please also refer to FIG. 6 and FIG. 7. FIG. 6 is a sectional view of the keyswitch structure 1 in FIG. 4 with the keycap 12 having been pressed. FIG. 7 is a sectional view of the keyswitch structure 1 in FIG. 5 with the keycap 12 having been pressed. When the keycap 12 is pressed by an external force (e.g. the user presses the keycap 12 by a finger), the first support 142 rotates about the sharp edge 1422*a* relative to the base 10, and the first magnetic portion 1426 moves away from the first magnetic member 16. At the same time, the second support 144 rotates about the sharp edge 1442*a* relative to the base 10, and the abutting portion 1446 moves away from the base 10. Hence, the keycap 12 approaches the base 10, as shown by FIG. 6 and FIG. 7. In the moving down of the keycap 12, when the first magnetic portion 1426 moves away from the first magnetic member 16, under the magnetic attraction effect by the second magnetic member 18 (i.e. under the effect of the magnetic attraction force F3), the second support 144 rotates about the sharp edge 1442*a* toward the abutting plate 106, i.e. closing the abutting plate 106, so that the abutting portion 1446 can still remain abutting against the first magnetic portion 1426. Therefore, during the moving down of the keycap 12, the whole lift mechanism 14 makes the keycap 12 vertically move toward the base 10 steadily.

When the external force is eliminated (e.g. the user moves his finger away from the keycap 12), the first support 142 and the second support 144 are substantially under only the effect of the magnetic attraction forces F1, F2 and F3. Based on the structural design of the embodiment, a moment to the first support 142 produced by the magnetic attraction force F1 is larger, even much larger than a sum of a moment to the first support 142 produced by the magnetic attraction force F2 and a moment indirectly to the first support 142 produced by the magnetic attraction force F3, so the magnetic attraction force F2 still can drive the first support 142 to rotate about the sharp edge 1422*a* relative to the abutting plate 106 of the base 10. Similarly, during a moving up of the keycap 12, the whole lift mechanism 14 makes the keycap 12 vertically move away from the base 10 steadily.

It is added that in the embodiment, the keyswitch structure 1 is substantially a multiple-width keyswitch. The first support 142 and the second support 144 extend in the horizontal direction D2, so the keycap 12 can be wholly supported by the support 142 and the second support 144. Under the effect by the second magnetic members 18, the first support 142 and the second support 144 can rotate simultaneously in the horizontal direction D2, so the keycap 12 can steadily move up and down relative to the base 10, and the keycap 12 will not obviously tilt when pressed by the user. The first support 142 and the second support 144 respectively have a protrusion 142*a* and 144*a*. When the keycap 12 is pressed down, the protrusions 142*a* and 144*a* can trigger the switches 104*a* and 104*b* respectively, as shown by FIG. 6.

Furthermore, in the embodiment, the base 10 includes two positioning structures 108*a* and 108*b*. The first support 142 includes a positioning structure 1430 adjacent to the first magnetic portion 1426 corresponding to the positioning structure 108*a*. The second support 144 includes a positioning structure 1450 adjacent to the abutting portion 1446 according to the positioning structure 108*b*. The positioning structures 108*a* and 180*b* of the base 10 are engaged with the positioning structures 1430 and 1450 of the first support 142 and the second support 144 respectively, so that the relative position of the first magnetic portion 1426 and the first magnetic member 16 and the relative position of the abutting portion 1446 and the first magnetic portion 1426 can be maintained, so that the interaction between the first magnetic portion 1426, the first magnetic member 16, and the abutting portion 1446 can work normally. In the embodiment, each of the positioning structures 108*a* and 180*b* is a pair of protrusions, and each of the positioning structures 1430 and 1450 is a pair of through holes for the protrusions to pass through for the positioning effect of the first magnetic portion 1426 and the abutting portion 1446 relative to the base 10.

In addition, in the embodiment, the base 10 includes two horizontal constraining structures 110*a* and 110*b*. The first support 142 includes a constrained structure 1432 corresponding to the horizontal constraining structure 110*a*. The constrained structure 1432 is farther from the first magnetic portion 1426 relatively, at least being closer to the two ends of the first support 142 in the horizontal direction D2 than the second magnetic portion 1428 (corresponding to the second magnetic member 18). The second support 144 includes a constrained structure 1452 corresponding to the horizontal constraining structure 110*b*. The constrained structure 1452 is farther from the abutting portion 1446 relatively, at least being closer to the two ends of the first support 142 in the horizontal direction D2 than the magnetic portion 1448 (corresponding to the second magnetic member 18). The horizontal constraining structures 110*a* and 110*b* constrain the constrained structures 1432 and 1452 respectively so that the movements of the first support 142 and the second support 144 in the horizontal direction D2 are limited. In the embodiment, each of the constrained structures 1432 and 1452 includes two protrusions protruding from the first side edge portion 1422*a* and the third side edge portion 1442*a* respectively. The first magnetic portion 1426 and the abutting portion 1446 are constrained between the two protrusions of the constrained structures 1432 and 1452 respectively. Each of the horizontal constraining structures 110*a* and 110*b* includes two blocking parts correspondingly. The two protrusions are located between the two blocking parts correspondingly. The two blocking parts block the two protrusions in the horizontal direction D2 so that the movements of the first support 142 and the second support 144 in the horizontal direction D2 is limited.

Figure 8:
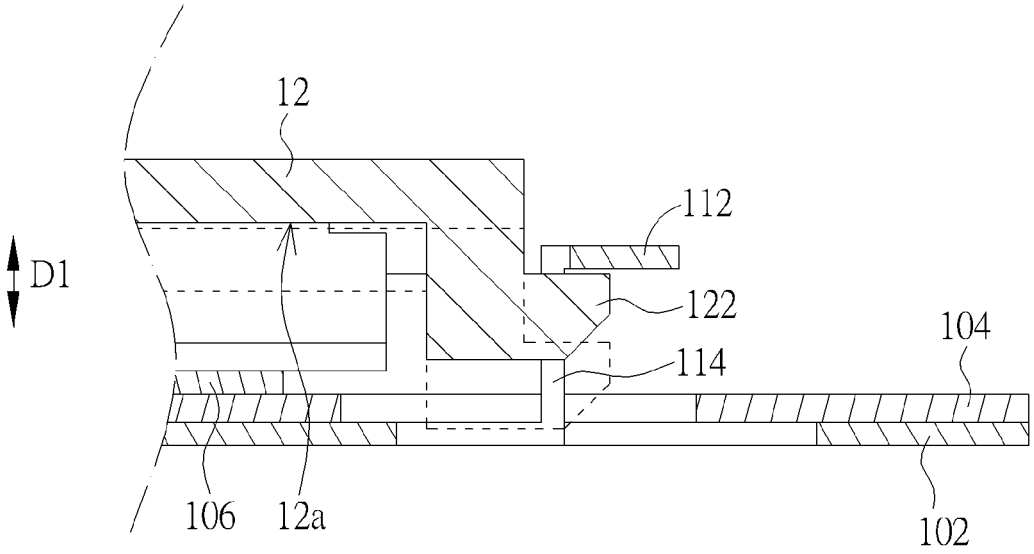
FIG. 8 is a sectional view of the keyswitch structure along the line Z-Z in FIG. 3.

In addition, please also refer to FIG. 8 which is a sectional view of the keyswitch structure 1 along the line Z-Z in FIG. 3; therein, the keycap 12 is shown by dashed lines when pressed. In the embodiment, relative to the lift mechanism 14, the keycap 12 is placed directly on the lift mechanism 14, so the lift mechanism 14 itself does not constrain the keycap 12 in height. But in the embodiment, the base 10 further includes a vertical constraining structure 112. The keycap 12 includes a constrained structure 122 correspondingly. The vertical constraining structure 112 constrains the constrained structure 122 so that the movement of the keycap 12 in the vertical direction D1 is limited. Furthermore, the base 10 further includes a vertical guiding structure 114. The keycap 12 includes a vertical guided structure (i.e. the same structure as the constrained structure 122). The vertical guided structure 122 slides limitedly in the vertical guiding structure 114 as the keycap 12 moves up and down in the vertical direction D1 relative to the base 10. In the embodiment, the vertical guiding structure 114 has a sliding slot at each side of the base 10 in the horizontal direction D2. The vertical guiding structure 114 and the vertical constraining structure 112 are structurally integrated. An end of the sliding slot (i.e. the close end of the sliding slot) can function as the vertical constraining structure 112, so the constrained structure 122 and the vertical guided structure 122 of the keycap 12 can be integrated into a single structure (i.e. a structure like a block formed at each side of the keycap 12 in the horizontal direction D2, sliding in the sliding slot); however, the invention is not limited thereto. It is added that the vertical guided structure 122 only vertically slides in the vertical guiding structure 114, and the vertical guiding structure 114 also has a horizontally constraining effect on the keycap 12 (i.e. constraining the movements in the vertical direction D1 and the vertical direction D1 of the keycap 12). In addition, in the embodiment, the positioning structures 108*a* and 108*b*, the horizontal constraining structures 110*a* and 110*b*, the vertical constraining structure 112, and the vertical guiding structure 114 of the base 10 are formed in a single piece, e.g. by stamping a metal plate; however, the invention is not limited thereto.

Figure 9:
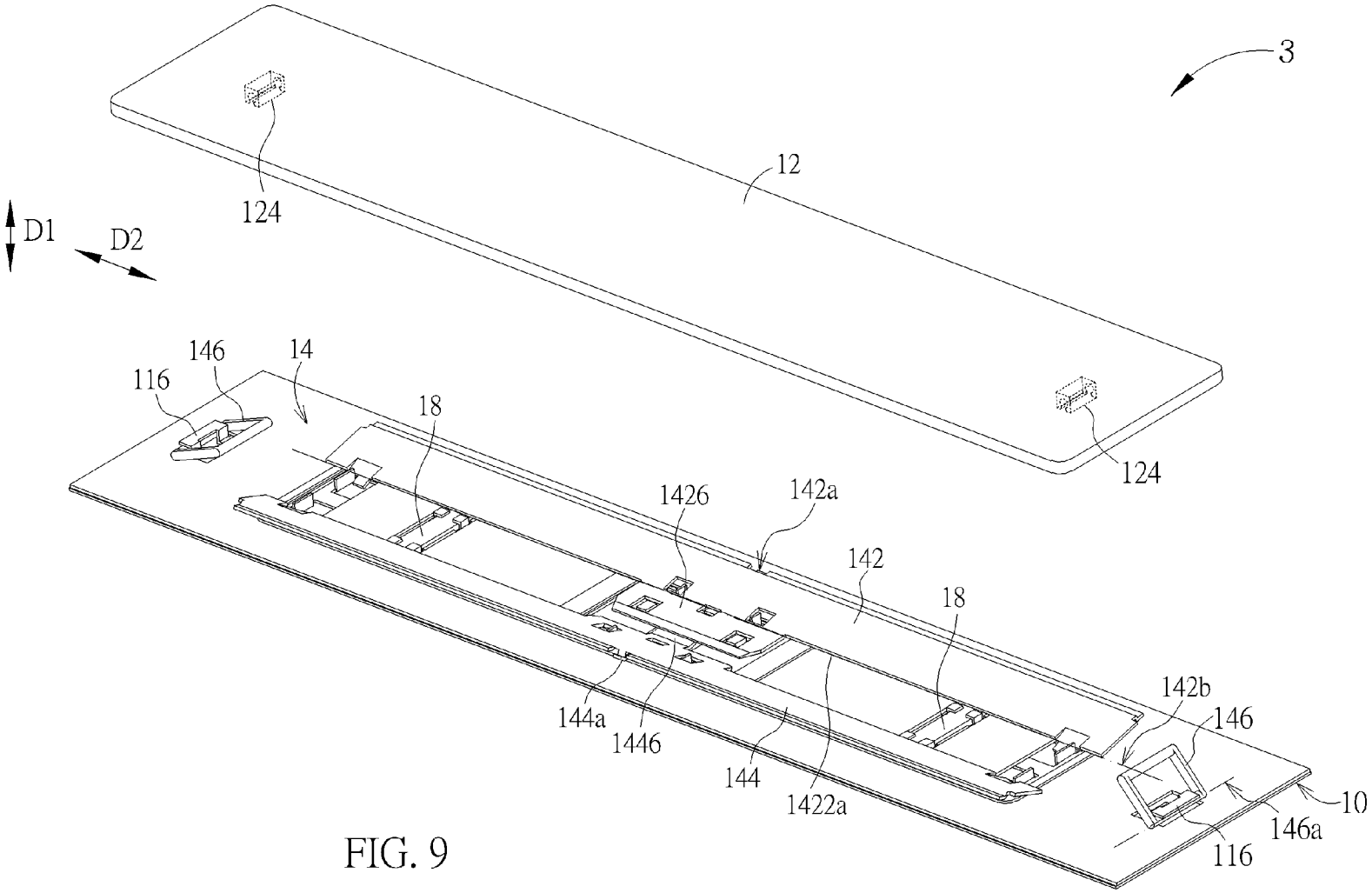
FIG. 9 is a partially-exploded view of a keyswitch structure of another embodiment according to the invention.

Please refer to FIG. 9, which is a partially-exploded view of a keyswitch structure 3 of another embodiment according to the invention. The keyswitch structure 3 is substantially structurally similar to the keyswitch structure 1, so the keyswitch structure 3 still uses the reference numbers of the keyswitch structure 1 in principle. For other descriptions about the keyswitch structure 3, please refer to the relevant descriptions about the keyswitch structure 1, which will not be repeated in addition. A difference between the keyswitch structure 3 and the keyswitch structure 1 is that the keyswitch structure 3 does not use the constrained vertical movement produced by the interaction between the vertical constraining structure 112, the vertical guiding structure 114, and the vertical guided structure 122. The lift mechanism 14 of the keyswitch structure 3 includes two third supports 146 that are symmetrically disposed in the horizontal direction D2 under two side edge portions of the keycap 12 respectively. Each third support 146 is connected to the base 10 and keycap 12 through connection portions 116 and 124 respectively. When the keycap 12 moves up and down relative to the base 10 in the vertical direction D1 through the lift mechanism 14, the first support 142 rotates about a first rotation axis 142*b* (indicated by a center line, equal to the sharp edge 1422*a*) relative to the base 10. The second support 144 rotates about a rotation axis (equal to the sharp edge 1442*a*) parallel to the first rotation axis 142*b* relative to the base 10. The third support 146 rotates about a second rotation axis 146*a* (indicated by a center line) relative to the base 10. Therein, the first rotation axis 142*b* and the second rotation axis 146*a* are non-parallel, so the keycap 12 is constrained by a plane constructed by the first rotation axis 142*b* and the second rotation axis 146*a* and then can steadily move up and down. In the embodiment, the first rotation axis 142*b* is perpendicular to the second rotation axis 146*a*, but the invention is not limited thereto. It is added that the first support 142 itself can constrain the movement of the keycap 12 on the first rotation axis 142*b*, so in practice, the lift mechanism 14 of the keyswitch structure 3 can make the keycap 12 steadily move up and down by a proper disposition of the first support 142 and the third support 146 (e.g. in a disposition that the first support 142 and the third support 146 can support the keycap 12 in equilibrium).

Figure 10:
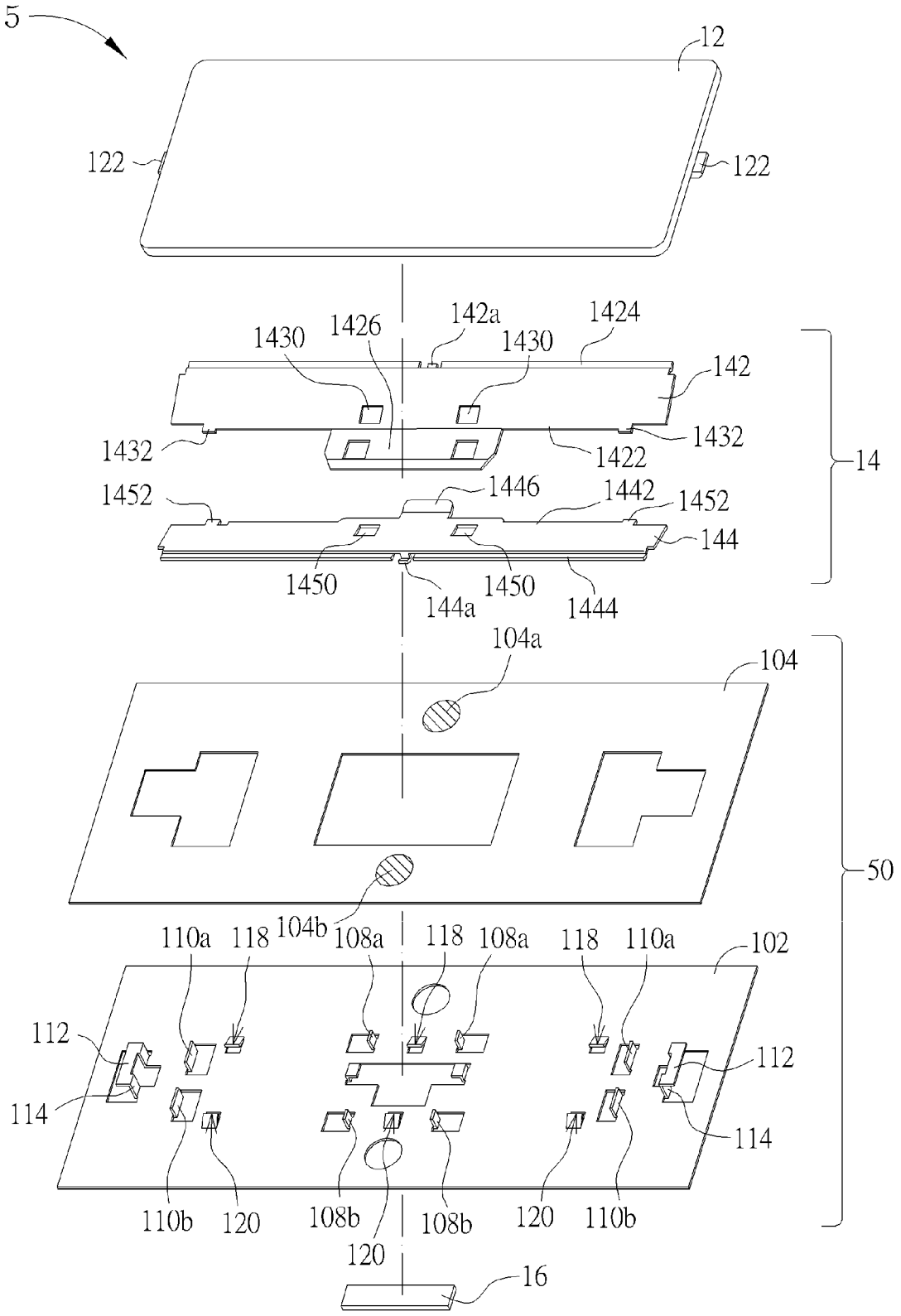
FIG. 10 is an exploded view of a keyswitch structure of another embodiment according to the invention.
Figure 11:
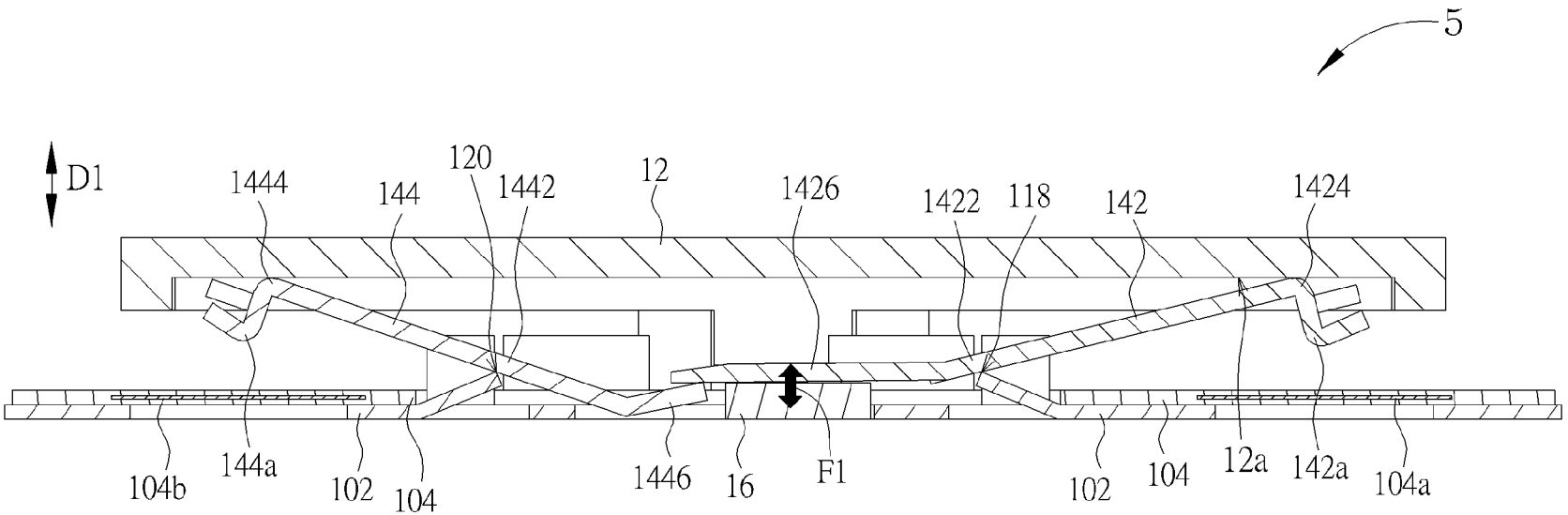
FIG. 11 is a sectional view of the keyswitch structure in FIG. 10.

In the above embodiments, the first side edge portion 1422 of the first support 142 abuts against the base 10 through the sharp edge 1422*a*. The third side edge portion 1442 of the second support 144 abuts against the base 10 through the sharp edge 1442*a*. Therein, the sharp edges 1422*a* and 1442*a* are disposed at the first side edge portion 1422 and the third side edge portion 1442, but the invention is not limited thereto. Please refer to FIG. 10 and FIG. 11. FIG. 10 is an exploded view of a keyswitch structure 5 of another embodiment according to the invention. FIG. 11 is a sectional view of the keyswitch structure 5; therein, the position of its cutting plane is indicated by the line X-X in FIG. 3. The keyswitch structure 5 is substantially structurally similar to the keyswitch structure 1, so the keyswitch structure 5 still uses the reference numbers of the keyswitch structure 1 in principle. For other descriptions about the keyswitch structure 5, please refer to the relevant descriptions about the keyswitch structure 1, which will not be repeated in addition. A difference between the keyswitch structure 5 and the keyswitch structure 1 is that in the keyswitch structure 5, the first side edge portion 1422 of the first support 142 abuts against a base 50 through a sharp edge 118, and the third side edge portion 1442 of the second support 144 abuts against the base 50 through a sharp edge 120. Therein, the sharp edges 118 and 120 are disposed on the base 50. In the embodiment, the sharp edges 118 and 120 are formed by bending upward a portion of a bottom plate 102 of the base 50 (e.g. by a stamping process). In this case, the abutting plate 106 is unnecessary for the base 50. Similarly, the keycap 12 of the keyswitch structure 5 can steadily move up and down relative to the base 50 through the first support 142 and the second support 144. For other movement illustrations about the keyswitch structure 5, please refer to the relevant descriptions about the keyswitch structure 1, which will not be repeated in addition. It is added that in the embodiment, the sharp edges 118 and 120 respectively consist of three short edge segments. In practice, the sharp edges 118 and 120 can be realized by more, longer edge segments, even by a single edge. For each of the above examples, in logic the set of the plurality of edge segments can be regarded as the sharp edge of the invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising:

a base;

a keycap;

a lift mechanism disposed between the base and the keycap, the keycap being capable of moving up and down in a vertical direction relative to the base through the lift mechanism, the lift mechanism comprising a first support, the first support having a first side edge portion, a second side edge portion opposite to the first side edge portion, and a first magnetic portion, the first side edge portion keeping abutting against the base through a sharp edge, the second side edge portion being movably connected with the keycap, the first magnetic portion extending outward from the first side edge portion; and a first magnetic member, disposed on the base corresponding to the first magnetic portion, the first magnetic member and the first magnetic portion producing a magnetic attraction force therebetween, when the keycap is pressed by an external force, the first support rotating about the sharp edge relative to the base, so that the first magnetic portion moves away from the first magnetic member and the keycap approaches the base, when the external force is eliminated, the magnetic attraction force driving the first support to rotate about the sharp edge relative to the base so that the keycap moves away from the base.

2. The keyswitch structure of claim 1, wherein the sharp edge is disposed at the first side edge portion or the base.

3. The keyswitch structure of claim 1, wherein the lift mechanism comprises a second support disposed opposite to the first support, the second support has a third side edge portion and a fourth side edge portion opposite to the third side edge portion, the third side edge portion keeps abutting against the base, and the fourth side edge portion is movably connected with the keycap.

4. The keyswitch structure of claim 3, wherein the second support further comprises an abutting portion extending outward from the third side edge portion, and the abutting portion abuts against the first support.

5. The keyswitch structure of claim 4, wherein the abutting portion is located between the first magnetic portion and the base.

6. The keyswitch structure of claim 4, wherein the base comprises two positioning structures, the first support comprises a positioning structure adjacent to the first magnetic portion, the second support comprises a positioning structure adjacent to the abutting portion, and the two positioning structures of the base are engaged with the two positioning structures of the first support and the second support respectively.

7. The keyswitch structure of claim 4, further comprising a second magnetic member disposed on the base between the first support and the second support, wherein the first support has a second magnetic portion corresponding to the second magnetic member, the second magnetic portion and the second magnetic member produce a magnetic attraction force therebetween for driving the first side edge portion to abut against the base, the second support has a third magnetic portion facing the second magnetic member, and the third magnetic portion and the second magnetic member produce a magnetic attraction force therebetween for driving the third side edge portion to abut against the base.

8. The keyswitch structure of claim 1, further comprising a second magnetic member disposed on the base under the first side edge portion, wherein the first support has a second magnetic portion facing the second magnetic member, and the second magnetic portion and the second magnetic member produce a magnetic attraction force therebetween for driving the first side edge portion to abut against the base.

9. The keyswitch structure of claim 1, further comprising two second magnetic members disposed on the base under the first side edge portion, the first magnetic member being located between the two second magnetic members, wherein the first support has two second magnetic portions facing the two second magnetic members respectively, and the two second magnetic portions and the two second magnetic members produce magnetic attraction forces therebetween for driving the first side edge portion to abut against the base.

10. The keyswitch structure of claim 9, wherein the first magnetic member and the two second magnetic member are arranged in a horizontal direction perpendicular to the vertical direction, the sharp edge extends in the horizontal direction, and the first magnetic portion is located at a middle portion of the first side edge portion.

11. The keyswitch structure of claim 1, wherein the base comprises a horizontal constraining structure, the sharp edge extends in a horizontal direction perpendicular to the vertical direction, the first support comprises a constrained structure, and the horizontal constraining structure constrains the constrained structure so that a movement of the first support in the horizontal direction is limited.

12. The keyswitch structure of claim 11, wherein the constrained structure comprises two protrusions protruding from the first side edge portion, the horizontal constraining structure comprises two blocking parts, the two protrusions are located between the two blocking parts, and the two blocking parts block the two protrusions in the horizontal direction.

13. The keyswitch structure of claim 12, wherein the first magnetic portion is located between the two protrusions.

14. The keyswitch structure of claim 1, wherein the base comprises a vertical constraining structure, the keycap comprises a constrained structure, and the vertical constraining structure constrains the constrained structure so that a movement of the keycap in the vertical direction is limited.

15. The keyswitch structure of claim 1, wherein the base comprises a vertical guiding structure, the keycap comprises a vertical guided structure, and the vertical guided structure of the keycap slides limitedly in the vertical guiding structure as the keycap moves up and down relative to the base in the vertical direction.

16. The keyswitch structure of claim 1, wherein the lift mechanism comprises a third support connected to the base and the keycap, when the keycap moves up and down relative to the base in the vertical direction through the lift mechanism, the first support rotates about a first rotation axis relative to the base, the third support rotates about a second rotation axis relative to the base, the first rotation axis and the second rotation axis are not parallel, and the first rotation axis and the second rotation axis are perpendicular to the vertical direction.

17. A keyswitch structure, comprising:

a base;

a keycap;

a first support having a first side edge portion, a second side edge portion opposite to the first side edge portion, and a first magnetic portion, the first side edge portion keeping abutting against the base, the second side edge portion being movably connected to the keycap, the first magnetic portion extending outward from the first side edge portion;

a second support disposed opposite to the first support, the second support having a third side edge portion and a fourth side edge portion opposite to the third side edge portion, the third side edge portion keeping abutting against the base, the fourth side edge portion being movably connected to the keycap; and a first magnetic member, disposed on the base corresponding to the first magnetic portion, the first magnetic member and the first magnetic portion producing a magnetic attraction force therebetween, when the keycap is pressed by an external force, the first support rotating about the first side edge portion relative to the base, so that the first magnetic portion moves away from the first magnetic member and the keycap approaches the base, when the external force is eliminated, the magnetic attraction force driving the first support to rotate about the first side edge portion relative to the base so that the keycap moves away from the base.

18. The keyswitch structure of claim 17, wherein the first side edge portion keeps abutting against the base through a sharp edge.

19. The keyswitch structure of claim 18, wherein the sharp edge is disposed on the first side edge portion or the base.

20. The keyswitch structure of claim 17, further comprising a second magnetic member disposed on the base between the first support and the second support, wherein the first support has a second magnetic portion facing the second magnetic member, the second magnetic portion and the second magnetic member produce a magnetic attraction force therebetween for driving the first side edge portion to abut against the base, the second support has a third magnetic portion facing the second magnetic member, and the third magnetic portion and the second magnetic member produce a magnetic attraction force therebetween for driving the third side edge portion to abut against the base.

21. The keyswitch structure of claim 17, wherein the second support further comprises an abutting portion extending outward from the third side edge portion, and the abutting portion abuts against the first support.

22. The keyswitch structure of claim 21, wherein the abutting portion abuts against the first magnetic portion.

23. A keyswitch structure, comprising:

a base;

a keycap;

a first support having a first side edge portion, a second side edge portion opposite to the first side edge portion, and a second magnetic portion, the first side edge portion keeping abutting against the base, the second side edge portion being movably connected to the keycap; and a second magnetic member, disposed corresponding to the second magnetic portion on the base under the first side edge portion, wherein the second magnetic portion and the second magnetic member produce a magnetic attraction force therebetween for driving the first side edge portion to abut against the base.

24. The keyswitch structure of claim 23, wherein the first side edge portion keeps abutting against the base through a sharp edge.

25. The keyswitch structure of claim 24, wherein the sharp edge is disposed on the first side edge portion or the base.

26. The keyswitch structure of claim 23, further comprising a second support disposed opposite to the first support, the second support having a third side edge portion and a fourth side edge portion opposite to the third side edge portion, the third side edge portion keeping abutting against the base, the fourth side edge portion being movably connected to the keycap.

27. The keyswitch structure of claim 26, wherein the second support further comprises an abutting portion extending outward from the third side edge portion, and the abutting portion abuts against the first support.

28. The keyswitch structure of claim 27, further comprising a first magnetic member disposed on the base, wherein the first support has a first magnetic portion corresponding to the first magnetic member, and the abutting portion abuts against the first magnetic portion.

29. The keyswitch structure of claim 23, further comprising a second support disposed opposite to the first support, wherein the second support has a third side edge portion, a fourth side edge portion opposite to the third side edge portion, and a third magnetic portion corresponding to the second magnetic member, the third side edge portion keeps abutting against the base, the fourth side edge portion is movably connected to the keycap, the third magnetic portion and the second magnetic member produce a magnetic attraction force therebetween for driving the third side edge portion to abut against the base.

30. The keyswitch structure of claim 23, wherein the first support further has a first magnetic portion extending outward from the first side edge portion, the keyswitch structure further comprises a first magnetic member disposed on the base corresponding to the first magnetic portion, the first magnetic member and the first magnetic portion producing a magnetic attraction force therebetween, when the keycap is pressed by an external force, the first support rotates about the first side edge portion relative to the base, so that the first magnetic portion moves away from the first magnetic member and the keycap approaches the base, and when the external force is eliminated, the magnetic attraction force drives the first support to rotate about the first side edge portion relative to the base so that the keycap moves away from the base.

* * * * *